US007175546B2

(12) United States Patent
Asakura

(10) Patent No.: US 7,175,546 B2
(45) Date of Patent: Feb. 13, 2007

(54) GOLF BALL

(75) Inventor: Takeshi Asakura, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/853,274

(22) Filed: May 26, 2004

(65) Prior Publication Data

US 2005/0014579 A1 Jan. 20, 2005

(30) Foreign Application Priority Data

Jul. 14, 2003 (JP) ..... 2003-274202

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,813,677 A 3/1989 Oka et al.
4,830,378 A * 5/1989 Aoyama ..... 473/384
4,991,852 A * 2/1991 Pattison ..... 473/379
6,290,615 B1 9/2001 Ogg
6,461,253 B2 10/2002 Ogg

FOREIGN PATENT DOCUMENTS

JP 7-289662 A 7/1995
JP 2003-47674 A 2/2003

* cited by examiner

*Primary Examiner*—Raeann Gorden
(74) *Attorney, Agent, or Firm*—Birch, Stewart, Kolasch & Birch, LLP

(57) ABSTRACT

Golf ball 1 has multisurface dimples 4*a*. The multisurface dimple 4*a* has a central concave face 7 and six inclined faces 8. The inclined face 8 extends obliquely upward from the edge 9 of the central concave face 7 up to the phantom sphere. Two multisurface dimples 4*a* are adjacent each other sharing a boundary line 10 on spherical surface interpositioned therebetween. Total length of the boundary lines 10 that exist at the site where multisurface dimples 4*a* are adjacent each other is equal to or less than 2400 mm. Proportion of the multisurface dimples 4*a* occupied in total number of dimples is preferably equal to or greater than 70%. Proportion of the number of the boundary lines 10 occupied in the number of sites where multisurface dimples 4*a* are adjacent each other is equal to or greater than 70%.

18 Claims, 7 Drawing Sheets

GOLF BALL

This application claims priority on Patent Application No. 2003-274202 filed in Japan on Jul. 14, 2003.

BACKGROUND OF THE INVENTION

1. Field of the Invention

The present invention relates to golf balls. More particularly, the present invention relates to improvement of dimples of a golf ball.

2. Description of the Related Art

Golf balls have numerous dimples on the surface thereof. Surface shape of general dimples is circular. A role of the dimples involves causing turbulent flow separation through disrupting the air flow around the golf ball during the flight. By causing the turbulent flow separation, a separating point of air from the golf ball shifts backwards leading to the reduction of a drag coefficient (Cd). The turbulent flow separation promotes the differentia between the separating points at the upper and lower sides of the golf ball, which result from the backspin, thereby enhancing the lift force that acts upon the golf ball. Flight distance of the golf ball is prolonged on behalf of the reduced drag and enhanced lift force. Aerodynamically excellent dimples promote the turbulent flow separation. In other words, aerodynamically excellent dimples can disturb the air flow more efficiently.

Specifications that greatly affect flight performances of a golf ball include density of dimples (also referred to as "occupation ratio"). Golf balls having a great density are excellent in flight performances. Various proposals have been made regarding the density. U.S. Pat. No. 4,813,677 discloses a golf ball provided with dimples that are densely arranged such that any new dimple having an area that is greater than the average area can not be formed.

Of the surface of a golf ball, a part other than dimples is referred to as a land. The land having a great area inhibits aerodynamic characteristics of the golf ball. When the plane shape of a dimple is circular, it is impossible to completely fill the surface of the golf ball with dimples. According to golf balls having circular dimples arranged thereon, a land having a certain area is inevitably generated.

Cross-sectional shape of a dimple has been contrived, and thus golf balls with a reduced land have been proposed. JP-A No. 7-289662 and JP-A No. 2003-47674 corresponding to the divisional application of the same disclose a golf ball with a reduced land area through the use of hexagonal dimples. U.S. Pat. No. 6,290,615 and U.S. Pat. No. 6,461,253 disclose golf balls having the surface thereof provided with lattice protrusions and concave portions, thereby reducing the land area.

Top concern of golf players for golf balls is the travel distance. In light of the improvement of travel distance, there remains room for improvement of the dimple. An object of the present invention is to improve the flight performance of a golf ball.

SUMMARY OF THE INVENTION

The golf ball according to the present invention has numerous dimples on the surface thereof. Multisurface dimples are included in these dimples. The multisurface dimple is composed of a central concave face and plural inclined faces extending obliquely upward from the edge of this central concave face. This golf ball has a boundary line that exists on a phantom spherical surface at a site where the multisurface dimples are adjacent each other. Total length of these boundary lines on spherical surface is equal to or less than 2400 mm. According to this golf ball, dimples promote the turbulent flow separation during flight. This golf ball is excellent in the flight performance.

Preferably, proportion of the number of the multisurface dimples occupied in total number of dimples is equal to or greater than 70%. Preferably, proportion of the number of sites where the multisurface dimples are adjacent each other sharing the boundary line on spherical surface interpositioned therebetween, occupied in the number of sites where multisurface dimples are adjacent each other is equal to or greater than 70%.

DESCRIPTION OF THE PREFERRED EMBODIMENTS

The present invention is hereinafter described in detail with appropriate references to the accompanying drawing according to the preferred embodiments of the present invention.

Figure 1:
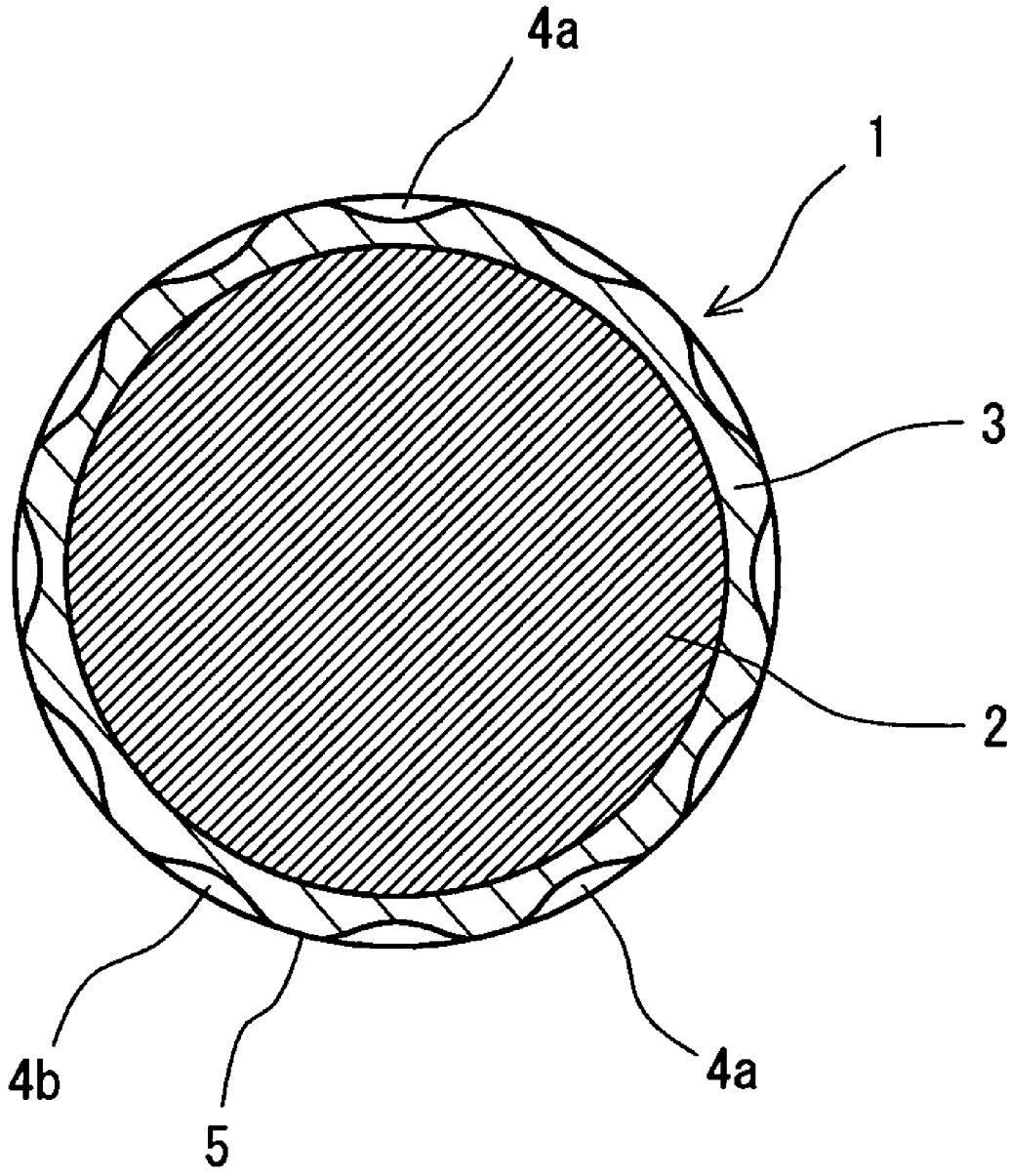
FIG. 1 is a schematic cross-sectional view illustrating a golf ball according to one embodiment of the present invention.

A golf ball 1 shown in FIG. 1 has a spherical core 2 and a cover 3. Numerous dimples 4*a*, 4*b* are formed on the surface of the cover 3. Of the surface of the golf ball 1, regions other than the dimples 4*a*, 4*b* are lands 5. This golf ball 1 has a paint layer and a mark layer to the external side of the cover 3, although these layers are not shown in the Figure.

This golf ball 1 has a diameter of from 40 mm to 45 mm. From the standpoint of conformity to a rule defined by United States Golf Association (USGA), the diameter is preferably equal to or greater than 42.67 mm. In light of reduction of the air resistance, the diameter is preferably equal to or less than 44 mm, and more preferably equal to or less than 42.80 mm. Weight of this golf ball 1 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 2 is formed through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking of the core 2, a co-crosslinking agent is usually used. Preferable examples of the co-crosslinking agent in light of the resilience performance include zinc acrylate, magnesium acrylate, zinc methacrylate and magnesium methacrylate. In the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, sulfur, an anti-aging agent, a coloring agent, a plasticizer, a dispersant and the like may be blended at an appropriate amount to the rubber composition as needed. Crosslinked rubber powder or synthetic resin powder may be blended to the core 2.

The core 2 has the diameter of 30.0 mm or greater and 42.0 mm or less, and particularly of 38.0 mm or greater and 41.5 mm or less. The core 2 may be composed of two or more layers.

The cover 3 is formed from a synthetic resin composition. Illustrative examples of the base resin for use in the cover 3 include ionomer resins, thermoplastic styrene elastomers, thermoplastic polyurethane elastomers, thermoplastic polyamide elastomers, thermoplastic polyester elastomers and thermoplastic polyolefin elastomers.

An appropriate amount of a coloring agent, a filler, a dispersant, an antioxidant, an ultraviolet absorbent, a light stabilizer, a fluorescent agent, a fluorescent brightening agent or the like may be blended to the cover 3 as needed. For the purpose of adjusting the specific gravity, powder of a highly dense metal such as tungsten, molybdenum or the like may be blended to the cover 3.

The cover 3 has the thickness of usually 0.3 mm or greater and 6.0 mm or less, and particularly of 0.6 mm or greater and 2.4 mm or less. The cover 3 may be composed of two or more layers.

Figure 2:
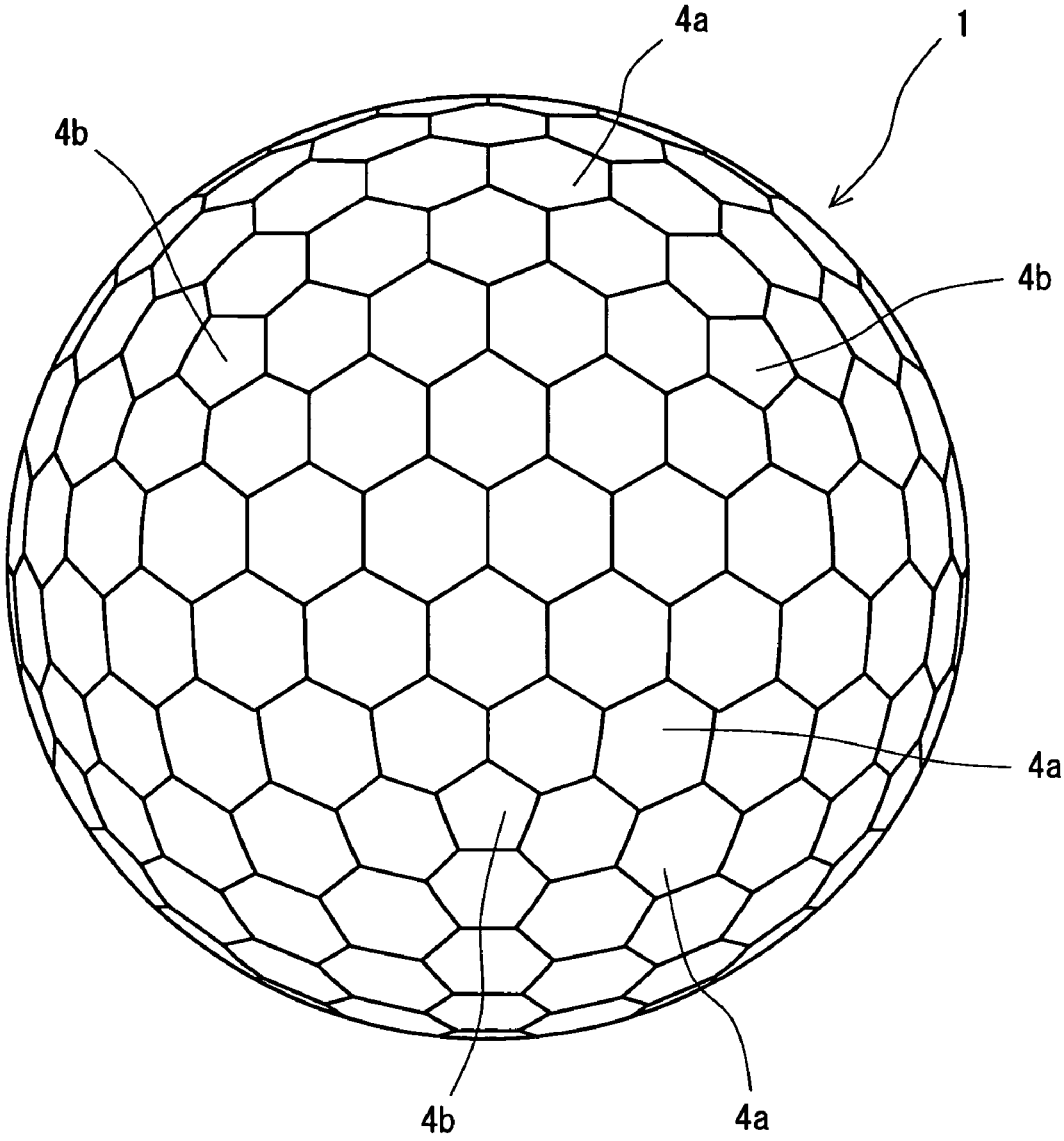
FIG. 2 is a front view illustrating the golf ball shown in FIG. 1.

FIG. 2 is a front view illustrating the golf ball 1 shown in FIG. 1. As is clear from FIG. 2, this golf ball 1 has first dimples 4*a* of which plane shape being substantially hexagonal and second dimples 4*b* of which plane shape being substantially pentagonal. The number of the first dimples 4*a* is 240; and the number of the second dimples 4*b* is 12. Total number of the dimples of this golf ball 1 is 252.

Figure 3:
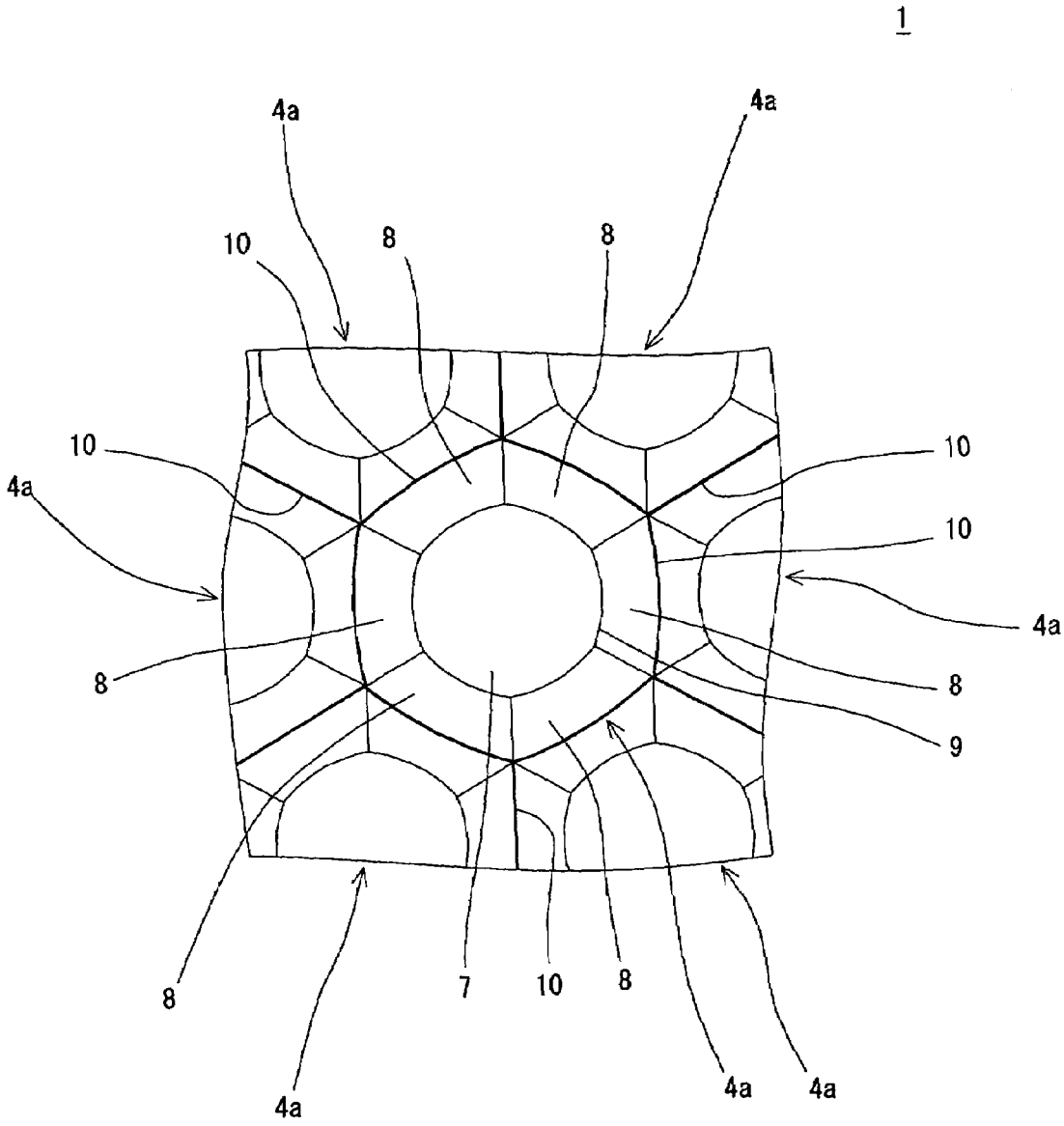
FIG. 3 is an enlarged view illustrating a part of the golf ball shown in FIG. 1.
Figure 4:
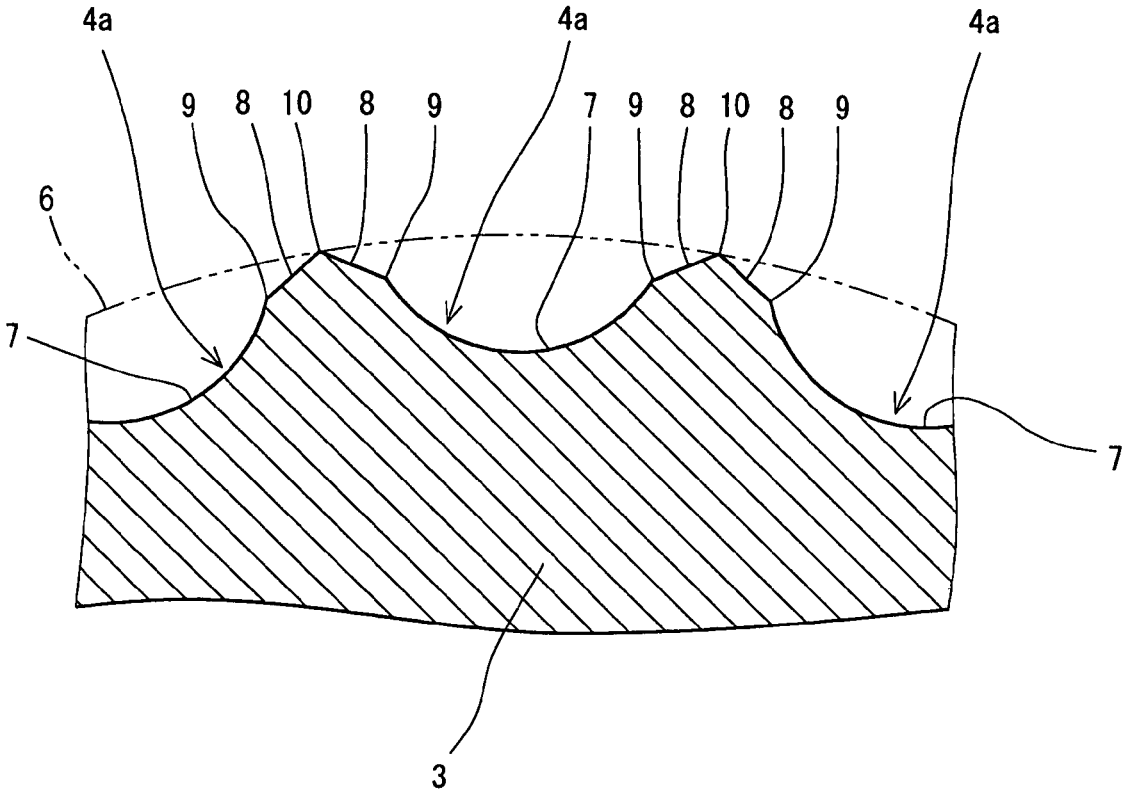
FIG. 4 is a cross-sectional view illustrating the golf ball shown in FIG. 3.

FIG. 3 is an enlarged view illustrating a part of the golf ball 1 shown in FIG. 1, and FIG. 4 is a cross-sectional view of the same. In these Figures, the first dimples 4*a* are depicted. What is indicated by a chain double-dashed line in FIG. 4 is a phantom sphere 6. The surface of the phantom sphere 6 is the surface of the golf ball 1 to be present when it is postulated that there exists no dimple.

The dimple 4*a* has a central concave face 7 and six inclined faces 8. The inclined face 8 extends obliquely upward from the edge 9 of the central concave face 7 up to the phantom sphere 6. Although not shown in the Figure, the second dimple 4*b* also has a central concave face 7 and inclined faces 8. The number of the inclined faces 8 of the second dimple 4*b* is five. According to the present invention, such a dimple composed of a central concave face 7 and plural inclined faces 8 extending obliquely upward from the edge 9 of this central concave face 7 is referred to as a multisurface dimple. The first dimple 4*a* and the second dimple 4*b* are involved in exemplary multisurface dimples.

What is indicated by a reference numeral 10 in FIG. 3 and FIG. 4 is a boundary line. Two multisurface dimples 4*a* are adjacent while sharing the boundary line 10 interpositioned therebetween. The boundary line 10 defines the edge of the inclined face 8 of one of the multisurface dimples 4*a*, and concurrently defines the edge of the inclined face 8 of another one of the multisurface dimples 4*a* as well. This boundary line 10 is present on the surface of the phantom sphere 6. In other words, the boundary line 10 is a curve depicted on the surface of the phantom sphere 6. The boundary line 10 also corresponds to the land 5. In an example shown in FIG. 3 and FIG. 4, the boundary line 10 is depicted at the adjacent site shared by the first dimples 4*a*, however, a similar boundary line 10 is present at the adjacent site shared by the first dimple 4*a* and the second dimple 4*b*.

Although a land having a great area is present between circular dimples that are adjacent each other in conventional golf balls, according to the golf ball 1 shown in FIG. 2, only the boundary line 10 is present between multisurface dimples that are adjacent each other. In this golf ball 1, the area of the land 5 is reduced on behalf of the inclined faces 8. In this golf ball 1, occupation ratio of total dimple area to the surface area of the phantom sphere 6 is great. Great occupation ratio is responsible for promotion of the turbulent flow separation. This golf ball 1 is excellent in the flight performance.

Theoretically, the width of the boundary line 10 should be zero, and thus, area of the land 5 consisting of the boundary line 10 should be zero. However, resulting from the edge run, the actual boundary line 10 has a substantive width although small, and the actual land 5 has a substantive area although small. Even though the boundary line 10 has just a small width, substantial occupation ratio is reduced when there exist a lot. In the golf ball 1 shown in FIG. 2, total length of the boundary lines 10 that exist at the site where multisurface dimples 4*a*, 4*b* are adjacent each other is set to be equal to or less than 2400 mm. According to this golf ball 1, reduction of the occupation ratio resulting from the boundary line 10 is suppressed. This golf ball 1 is extremely excellent in the flight performance. In light of the flight performance, total length of the boundary lines 10 that exist at the site where multisurface dimples 4*a*, 4*b* are adjacent each other is more preferably equal to or less than 2300 mm, and particularly preferably equal to or less than 2200 mm. In light of retention of characteristic of the golf ball 1 which is substantially spherical, total length of the boundary lines 10 that exist at the site where multisurface dimples 4*a*, 4*b* are adjacent each other is preferably equal to or greater than 1500 mm.

Other type of a dimple may be present mixed with the multisurface dimples 4*a*, 4*b*. In such instances of the presence in combination, proportion of the number of the multisurface dimples 4*a* and 4*b* occupied in total number of dimples is preferably equal to or greater than 70%, and more preferably equal to or greater than 80%. In the golf ball 1 shown in FIG. 2, all dimples are multisurface dimples 4*a* and 4*b*. Multisurface dimples having the plane shape of triangular, quadrangular, octagonal or the like may be provided.

There may exist the site where multisurface dimples 4*a*, 4*b* are adjacent each other sharing the boundary line 10 interpositioned therebetween may be present mixed with a site where multisurface dimples 4*a*, 4*b* are adjacent each other sharing a land 5 other than the boundary line 10, also interpositioned therebetween. In such instances of the presence in combination, proportion of the number of the sites where multisurface dimples 4*a*, 4*b* are adjacent each other sharing the boundary line 10 interpositioned therebetween, occupied in the number of all the adjacent sites is preferably equal to or greater than 70%, and more preferably equal to or greater than 80%. In the golf ball 1 shown in FIG. 2, this proportion is 100%. In other words, all the adjacent sites correspond to the boundary line 10 in the golf ball 1 shown in FIG. 2. The golf ball 1 shown in FIG. 2 has 750 adjacent sites, thus having 750 boundary lines 10.

In FIG. 4, the volume surrounded by the phantom sphere 6 and the dimple 4*a* is the volume of the dimple 4*a*. It is preferred that total volume of the dimples is 300mm$^3$ or greater and 750 mm$^3$ or less. When the total volume is less than the above range, the golf ball 1 is liable to hop. In this respect, the total volume is more preferably equal to or greater than 400 mm$^3$, and particularly preferably equal to or greater than 450 mm$^3$. When the total volume is beyond the above range, the golf ball 1 is liable to drop. In this respect, the total volume is more preferably equal to or less than 700 mm$^3$, and particularly preferably equal to or less than 650 mm$^3$.

It is preferred that total number of the dimples is 150 or greater and 360 or less. When the total number is less than the above range, a dimple effect as an entire golf ball is hardly achieved. In this respect, the total number is more preferably equal to or greater than 180, and particularly preferably equal to or greater than 230. When the total number is beyond the above range, achieving the dimple effect may be difficult due to small size of individual dimples. In this respect, the total number is more preferably equal to or less than 300, and particularly preferably equal to or less than 270.

Figure 5:
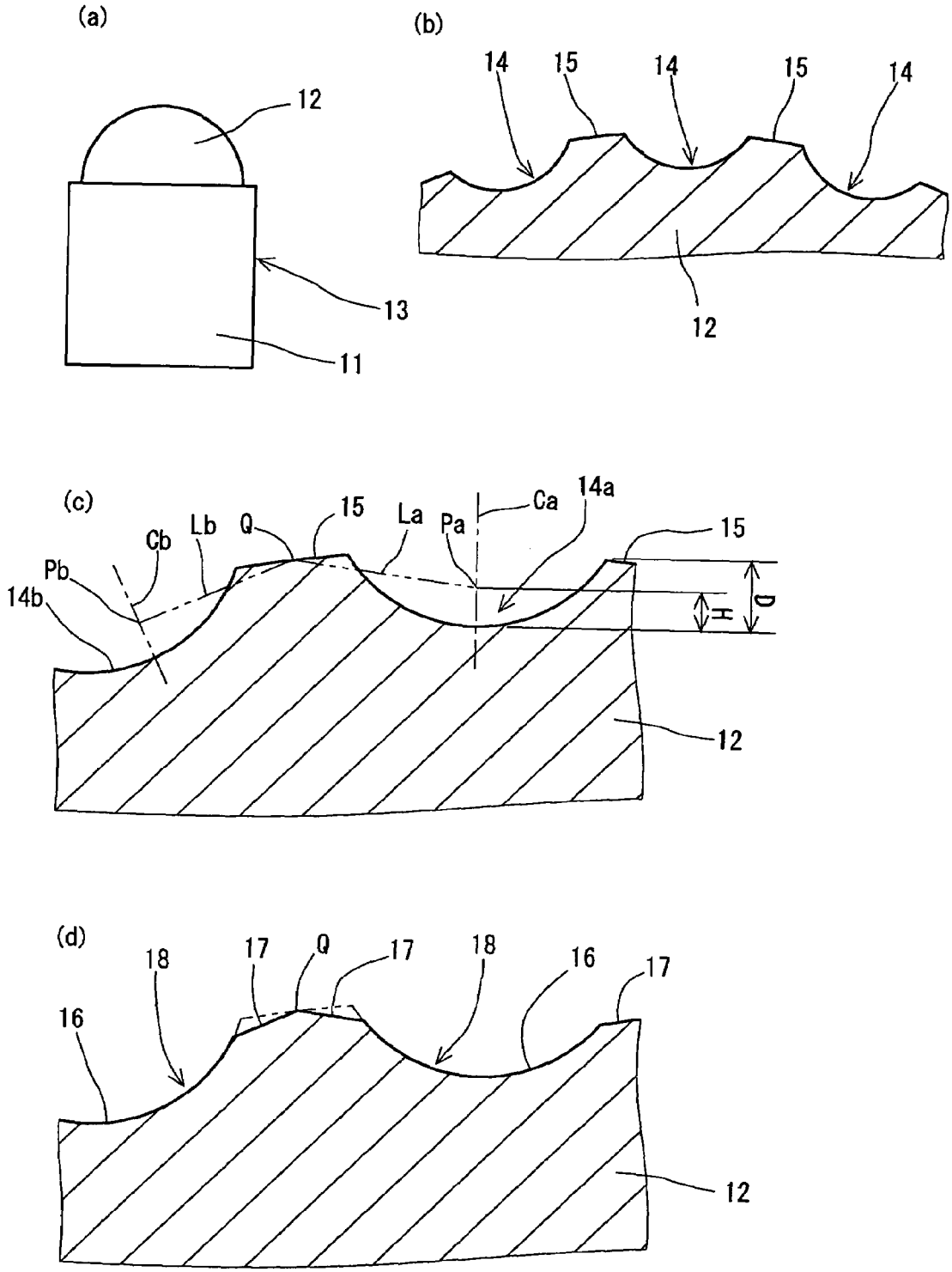
FIG. 5 is an explanatory drawing illustrating production of a master hob for the golf ball shown in FIG. 2.

FIG. 5 is an explanatory drawing illustrating production of a master hob for the golf ball 1 shown in FIG. 2. In order to obtain this master hob, a parent matrix 13 is provided which has a cylindrical portion 11 and a hemispherical convex portion 12 which is positioned at one end of this cylindrical portion 11. In FIG. 5(*a*), this parent matrix 13 is depicted.

Next, as shown in FIG. 5(*b*), numerous concave portions 14 are formed on the surface of this hemispherical convex portion 12. For forming the concave portions 14, a rotary cutting tool is used. Typical example of the cutting tool may be end mills. The concave portions 14 that are adjacent each other are positioned apart from each other. The region between the adjacent concave portions 14 is a land 15.

In FIG. 5(*c*), concave portions 14*a* and 14*b* that are adjacent each other are depicted. A point Pa on the central line Ca of the concave portion 14*a* and a point Q on the land 15 are envisioned. The point Pa is envisioned at a position where the ratio of the height H of this point Pa to the depth D of the concave portion 14*a* is 3/10 or greater and 7/10 or less. The point Q is envisioned at a position where a distance between this point Q and one concave portion 14*a* is almost identical to a distance between this point Q and another concave portion 14*b*. Then, a part of the land 15 is cut away according to a flat face or a curved face that includes a line La passing through the point Pa and the point Q. This cutting is carried out with a cutting tool. Also in another concave portion 14*b*, a part of the land 15 is cut away according to a face that includes a line Lb passing through a point Pb on the central line Cb and the point Q on the land 15.

Figure 6:
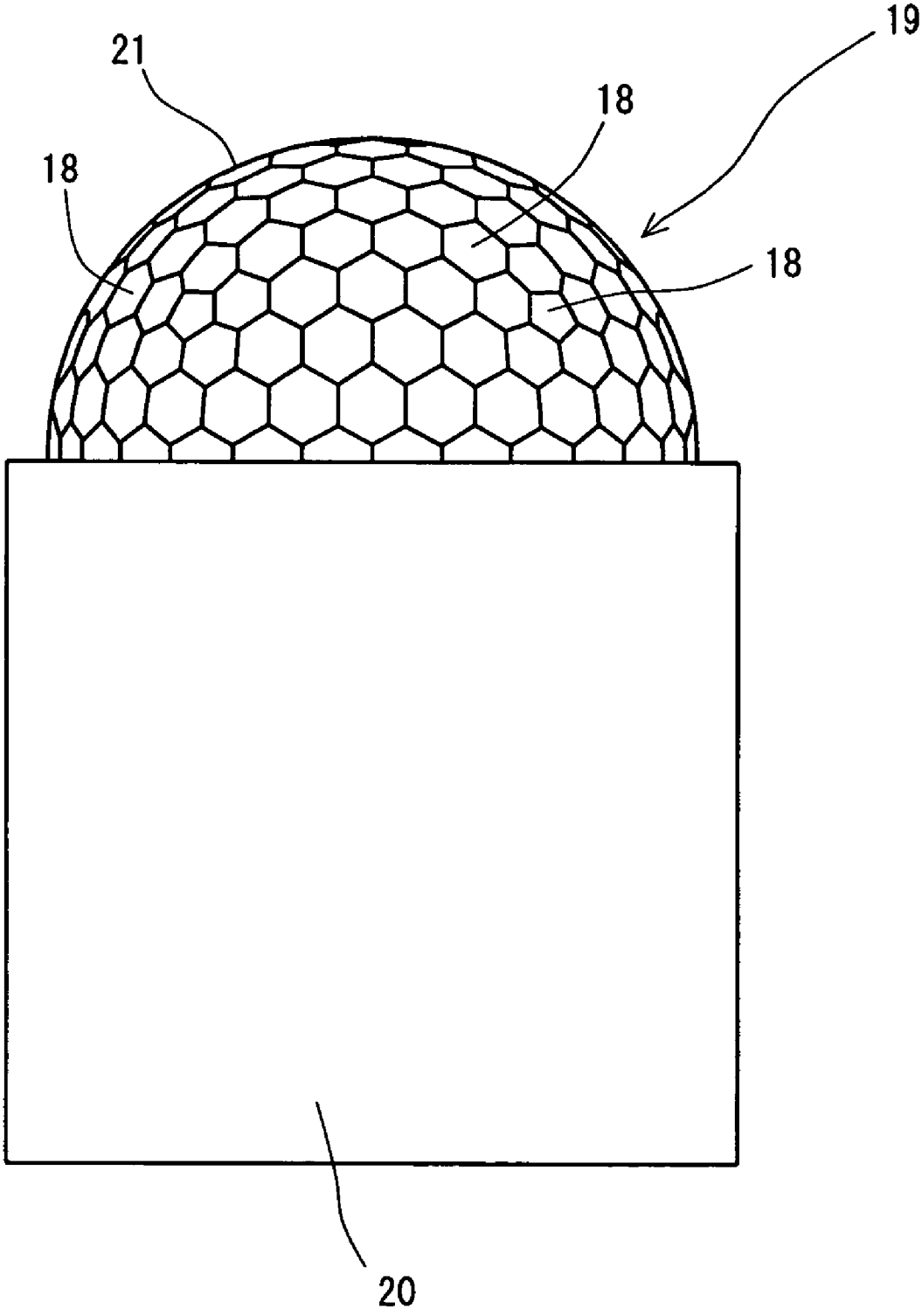
FIG. 6 is a front view illustrating the master hob obtained by the process illustrated in FIG. 5.

Cutting of the land 15 results in formation of a dimple 18 having a central concave face 16 and inclined faces 17, as shown in FIG. 5(*d*). This cutting forms a boundary line generated by sequentially aligned points Q. The operation of cutting is carried out for all the concave portions 14. Accordingly, production of a master hob 19 shown in FIG. 6 is completed. This master hob 19 has a cylindrical portion 20 and a hemispherical convex portion 21. The hemispherical convex portion 21 has numerous dimples 18. Using this master hob 19, a mold is generated. This mold has a cavity face having a shape inverted from the shape of the hemispherical convex portion 21. On this cavity face are formed numerous protrusions having a shape inverted from the shape of the dimples 18 of the master hob 19. Next, the golf ball 1 is molded with a spherical cavity provided by bringing a pair of the molds into contact. On the surface of the golf ball 1 are formed numerous multisurface dimples 4*a* and 4*b* having a shape inverted from the shape of the protrusions of the mold. These multisurface dimples 4*a* and 4*b* reflect the shape of the dimples 18 of the master hob 19.

EXAMPLES

Example

A core comprising a solid rubber and having the diameter of 38.4 mm was placed into a mold, and a cover was formed through injecting an ionomer resin composition around the core. Paint was applied over the surface of this cover to obtain a golf ball of Example having a dimple pattern as shown in FIG. 2. Specifications of dimples of this golf ball are listed in Table 1 below. This golf ball has the external diameter of about 42.70 mm, and the weight of about 45.4 g. Total volume of the dimples of this golf ball is about 500 mm$^3$. Compression of the golf ball as measured with a compression tester available from Atti Engineering Co., Ltd. is about 85.

Comparative Example

Figure 7:
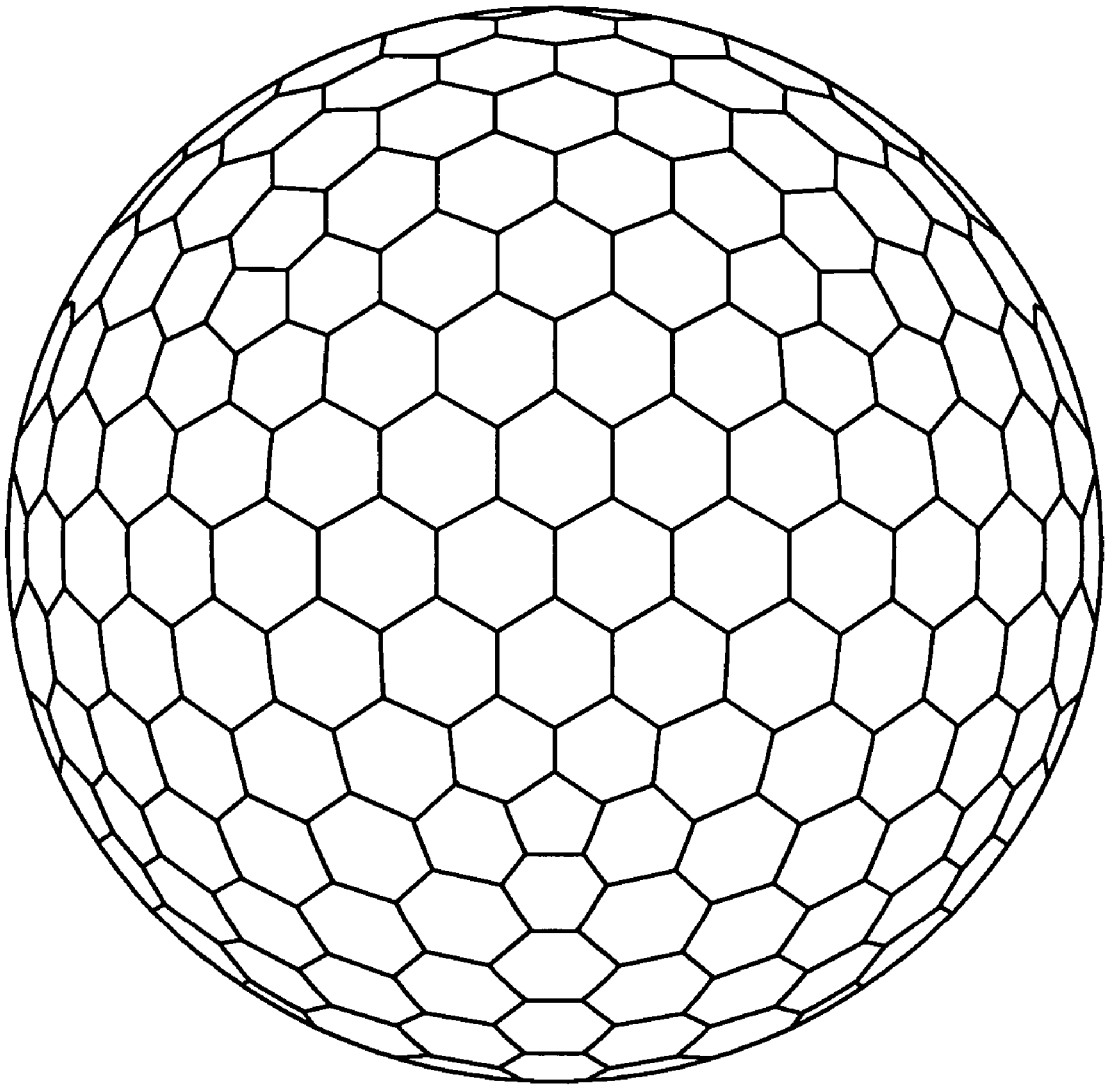
FIG. 7 is a front view illustrating a golf ball according to Comparative Example.

In a similar manner to Example except that the mold was changed, a golf ball of Comparative Example was obtained. Dimple pattern of this golf ball is shown in FIG. 7. Specifications of dimples of this golf ball are listed in listed in Table 1 below.

[Travel Distance Test]

A driver with a metal head ("NEW XXIO W#1", available from Sumitomo Rubber Industries, Ltd., loft: 11°, shaft hardness: R) was equipped with a swing machine (manufactured by Golf Laboratory Inc.). Then the golf ball was hit under a condition to give the head speed of 40 m/sec, the launch angle of about 12°, and the back spin rate of about 2800 rpm. Accordingly, travel distance (i.e., the distance from the launching point to the point where the ball stopped) was measured. Mean values of 20 times measurement are shown in Table 1 below.

TABLE 1

Result of evaluation

| | | Example | Comparative Example |
|---|---|---|---|
| Front view | | FIG. 2 | FIG. 7 |
| Number of dimples | pentagonal dimple | 12 | 12 |
| | hexagonal dimple | 240 | 350 |
| | Total | 252 | 362 |
| Number of multisurface dimples | | 252 | 362 |
| Number of sites where multisurface dimples are adjacent each other | | 750 | 1080 |
| Number of boundary lines on spherical surface | | 750 | 1080 |
| Total length of boundary lines on spherical surface (mm) | | 2133 | 2542 |
| Travel distance (m) | | 188 | 184 |

As is shown in Table 1, greater travel distance is achieved by the golf ball of Example in comparison with the golf ball of Comparative Example. Therefore, advantages of the present invention are clearly indicated by these results of evaluation.

The description herein above is just for an illustrative example, therefore, various modifications can be made without departing from the principles of the present invention.

What is claimed is:

1. A golf ball having numerous dimples on the surface thereof, wherein multisurface dimples composed of a central concave face and plural inclined faces extending obliquely upward from an edge of the central concave face are included in said dimples;

said golf ball comprises at least one boundary line that exists on a phantom spherical surface at a site where said multisurface dimples are adjacent each other;

a total length of the boundary lines is equal to or less than 2200 mm; and a total volume of the dimples is 300 to 750 $mm^3$.

2. The golf ball according to claim 1, wherein a proportion of a number of the multisurface dimples occupied in a total number of said dimples is equal to or greater than 70%.

3. The golf ball according to claim 1, wherein a proportion of a number of sites where the multisurface dimples are adjacent each other sharing a boundary line.

4. The golf ball according to claim 1, wherein the total length of the boundary lines is 1500 to 2200 mm.

5. The golf ball according to claim 1, wherein a total volume of the dimples is 400 to 700 $mm^3$.

6. The golf ball according to claim 1, wherein a total volume of the dimples is 450 to 650 $mm^3$.

7. The golf ball according to claim 1, wherein a total number of the dimples is 150 to 360.

8. The golf ball according to claim 1, wherein a total number of the dimples is 180 to 300.

9. The golf ball according to claim 1, wherein a total number of the dimples is 230 to 270.

10. A golf ball having numerous dimples on the surface thereof, wherein multisurface dimples composed of a central concave face and plural inclined faces extending obliquely upward from an edge of the central concave face are included in said dimples;

said golf ball comprises at least one boundary line that exists on a phantom spherical surface at a site where said multisurface dimples are adjacent each other;

a total length of boundary lines is equal to or less than 2300 mm; and a total volume of the dimples is 300 to 750 $mm^3$.

11. The golf ball according to claim 10, wherein the total length of the boundary lines is 1500 to 2300 mm.

12. The golf ball according to claim 10, wherein a proportion of a number of the multisurface dimples occupied in a total number of said dimples is equal to or greater than 70%.

13. The golf ball according to claim 10, wherein a proportion of a number of sites where the multisurface dimples are adjacent each other sharing a boundary line interpositioned therebetween which exists on a phantom spherical surface, occupied in a number of sites where said multisurface dimples are adjacent each other, is equal to or greater than 70%.

14. The golf ball according to claim 10, wherein a total volume of the dimples is 400 to 700 $mm^3$.

15. The golf ball according to claim 10, wherein a total volume of the dimples is 450 to 650 $mm^3$.

16. The golf ball according to claim 10, wherein a total number of the dimples is 150 to 360.

17. The golf ball according to claim 10, wherein a total number of the dimples is 180 to 300.

18. The golf ball according to claim 10, wherein a total number of the dimples is 230 to 270.

* * * * *